United States Patent [19]

Finn et al.

[11] Patent Number: 4,696,604

[45] Date of Patent: Sep. 29, 1987

[54] PILE ASSEMBLY FOR AN OFFSHORE STRUCTURE

[75] Inventors: Lyle D. Finn; Kenneth M. Steele, both of Houston, Tex.

[73] Assignee: Exxon Production Research Company, Houston, Tex.

[21] Appl. No.: 894,547

[22] Filed: Aug. 8, 1986

[51] Int. Cl.[4] ..... E02B 17/02

[52] U.S. Cl. ..... 405/227; 405/224; 405/228

[58] Field of Search ..... 405/227, 226, 225, 224, 405/195, 204, 228

[56] References Cited

U.S. PATENT DOCUMENTS

| | | | |
|---|---|---|---|
| 3,987,636 | 10/1976 | Hruska et al. | 405/227 X |
| 4,069,683 | 1/1978 | Jansz | 405/227 |
| 4,184,790 | 1/1980 | Bassett | 405/227 X |
| 4,378,179 | 3/1983 | Hasle | 405/227 |
| 4,421,438 | 12/1983 | Abbott et al. | 405/227 |
| 4,422,805 | 12/1983 | Sweatman | 405/225 |
| 4,422,806 | 12/1983 | Abbott et al. | 405/227 |
| 4,576,523 | 3/1986 | Smetak | 405/227 |
| 4,599,014 | 7/1986 | McGillivray et al. | 405/225 |

OTHER PUBLICATIONS

"Compliant Jacket Challenges Deep Water with New Design", McGillivray, T. L. et al., Oil & Gas Journal, May 6, 1985, pp. 112–115.

*Primary Examiner*—Dennis L. Taylor

*Attorney, Agent, or Firm*—Richard F. Phillips

[57] ABSTRACT

A pile assembly adapted for use in a compliant piled tower. A plurality of drive piles are driven into the ocean floor in a symetric array about a central, substantially vertical axis. A flex pile is secured to the upper end of each drive pile and extends upward to a preselected elevation above the ocean floor. The longitudinal axes of each drive pile flex pile pair are laterally offset from one another with the flex piles also being arranged in symetric array about the central axis. A tie member is provided to restrain the flex piles from lateral motion relative to one another. The tie member serves to balance the moments established by virtue of the eccentric axes of the flex pile drive pile pairs. The use of eccentric axes in the pile assemblies simplifies driving the drive piles, permits the drive piles to be placed relatively far from one another to minimize pile group effects and permits the flex pile to be designed without being constrained by driving considerations.

22 Claims, 6 Drawing Figures

PILE ASSEMBLY FOR AN OFFSHORE STRUCTURE

FIELD OF THE INVENTION

The present invention generally concerns pile assemblies for offshore structures. More specifically, the present invention concerns a pile assembly useful in providing vertical support and lateral stability to a bottom-founded compliant offshore tower.

BACKGROUND OF THE INVENTION

Most existing offshore oil and gas fields are drilled and produced from rigid structures which rest on the ocean bottom and extend upward to a work deck situated above the ocean surface. A key design constraint for such structures concerns limiting the dynamic amplification of the structure's response to waves. Failure to minimize such dynamic amplification will diminish the fatigue life of the structure, and in extreme cases can impose excessive loadings on key components of the structure. Avoidance of dynamic amplification is typically achieved by designing the structure to have rigidity sufficient to ensure that all of its natural vibrational periods are less than the shortest period of significant energy waves to which the structure will be exposed. For most offshore locations the shortest significant wave period is about seven seconds.

This type of structure, commonly termed a "rigid platform" or "fixed platform", has proved very satisfactory for applications in up to about 300 meters of water. However, as water depths exceed this, maintaining the fundamental natural vibrational period below seven seconds requires rapidly escalating stiffness. As a result, the cost of a rigid platform begins to increase rapidly as a function of water depth in depths beyond 300 meters.

For deep water applications, it has been proposed to depart from conventional rigid structure design and develop platforms having a fundamental natural period greater than the range of periods of ocean waves containing significant energy. Such platforms, termed "compliant structures," do not rigidly resist waves and other environmental forces, but instead compliantly resist environmental loads, undergoing significant lateral motion at the ocean surface either through sway (pivoting of the structure about its base) or bending (flexure of the structure about its length). The use of a compliant offshore structure effectively removes the upper bound on the sway or bending period, thus avoiding the most troublesome design constraint of rigid structures. This greatly reduces the increase in the volume of structural material, and hence cost, required for a given increase in water depth.

Because economic considerations have not yet warranted extensive exploitation of offshore hydrocarbon reserves in water depths greater than about 300 meters, the development of compliant structure technology is currently at a fairly early stage. However, several types of compliant structures have been designed and a few have been constructed. One of the most promising concepts for achieving compliancy is incorporated in a proposed structure known as the compliant piled tower. The compliant piled tower is a slender, substantially rigid space-frame tower extending from the ocean floor to a position above the ocean surface, where it supports a deck. The tower is not rigidly tied to the ocean floor, as is a conventional platform, but rather is permitted to tilt about its base. This permits the structure to respond compliantly to waves, wind and currents. The sway of the tower is stabilized by piles which extend upward from positions surrounding the base to a pile attachment position located a preselected elevation above the ocean floor. In response to sway of the tower away from the vertical, the piles establish a righting moment acting at the point of pile attachment. This provides the stabilization necessary to restore the tower to a vertical orientation. One type of a compliant piled tower is detailed in U.S. patent application Ser. No. 806,055, filed Dec. 5, 1985 and assigned to the assignee of the present application.

A key problem in developing a practical compliant piled tower centers on the design of the stabilizing piles. Initial conceptual designs for the compliant pile tower proposed the use of tubular members having a constant wall thickness and diameter. This does not, however, accommodate the competing requirements of those sections of the pile above and below the ocean floor. The section of the pile below the ocean floor should have a relatively large diameter and large wall thickness to satisfy driving and foundation considerations. However, that portion of the pile extending upward from the ocean floor to the attachment point on the tower should have a smaller diameter and wall thickness to yield the necessary longitudinal flexibility and to present the smallest possible cross-section to ocean currents.

It would be desirable to develop a pile assembly for a compliant piled tower which satisfies these competing pile requirements while permitting a simple and quick pile driving and attachment procedure in the course of platform installation.

SUMMARY OF THE INVENTION

In one aspect of the present invention, a pile assembly is provided which is useful in supporting and stabilizing a compliant offshore structure. The pile assembly includes a plurality of drive piles driven into the ocean floor with the upper end of each drive pile projecting above the ocean floor. A plurality of flex piles extend upward from a position adjacent the drive pile upper ends to a structure attachment location a spaced distance above the ocean floor. The lower end of each of the flex piles is connected to the upper end of one or more of the drive piles so that axial forces imposed on the flex piles are transmitted to and resisted by the drive piles. The flex piles are each aligned eccentrically to their corresponding drive pile. This permits the drive piles to be driven with the structure and flex piles in place. To minimize the effects of the moments resulting from the eccentric arrangement of the flex piles relative to the drive piles, the piles are arranged symmetrically about a vertical axis and the flex piles are tied together at their lower ends. This causes the load induced moments established at each eccentric flex pile, drive pile interface to balance.

Many advantages are provided by the use of the pile assembly of the present invention. By using an eccentric rather than collinear alignment of corresponding drive piles and flex piles, the drive piles may be driven in a conventional manner with the structure and flex piles in place. This greatly facilitates installation of the structure. Additionally, the use of separate components for the flexing portion and drive portion of each pile unit permits the competing requirements of these portions to be individually optimized. The eccentric pile arrangement also permits the drive piles to be set radially outward from the flex piles array. This increases the spacing between the drive piles, resulting in minimized pile group effects while permitting the flex piles to be closely clustered, minimizing lateral loadings imposed by ocean currents. Further advantages will become evident upon review of the following detailed description and appended claims.

BRIEF DESCRIPTION OF THE DRAWINGS

For a better understanding of the present invention, reference may be made to the accompanying drawings, in which.

These drawings are not intended to define or limit the invention, but are provided solely for the purpose of illustrating certain preferred embodiments of the invention, as described below.

DESCRIPTION OF THE PREFERRED EMBODIMENTS

Figure 1:
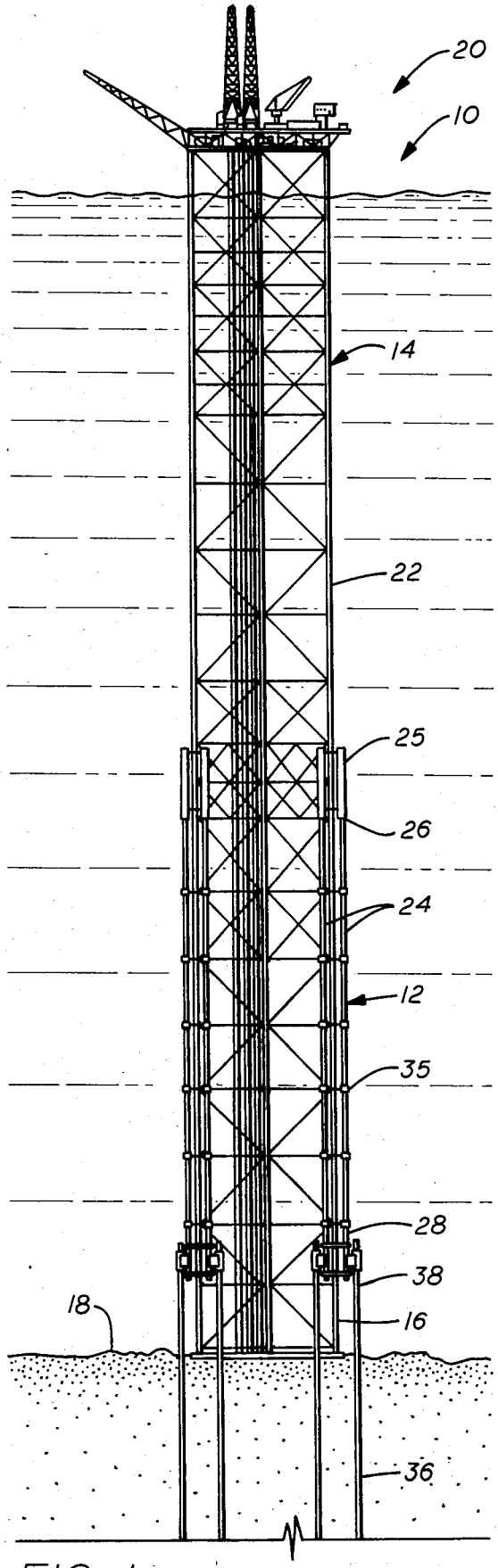
FIG. 1 is an elevational view of a compliant offshore structure incorporating a preferred embodiment of the pile assembly of the present invention.
Figure 4A:
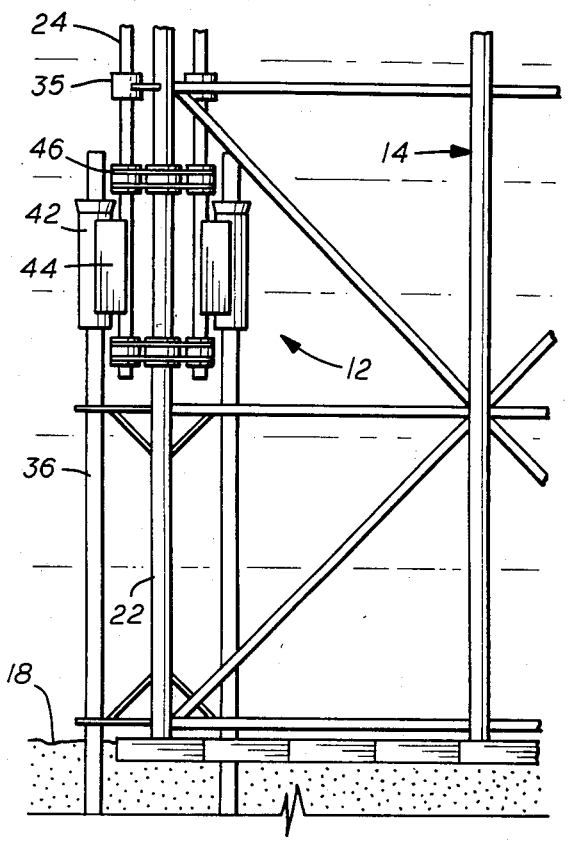
FIGS. 4*a* and 4*b* illustrate the behavior of the pile assembly shown in FIGS. 1–3 as the compliant structure tilts in response to environmental forces—the magnitude of the tilting has been exaggerated for the purposes of clarity.
Figure 4B:
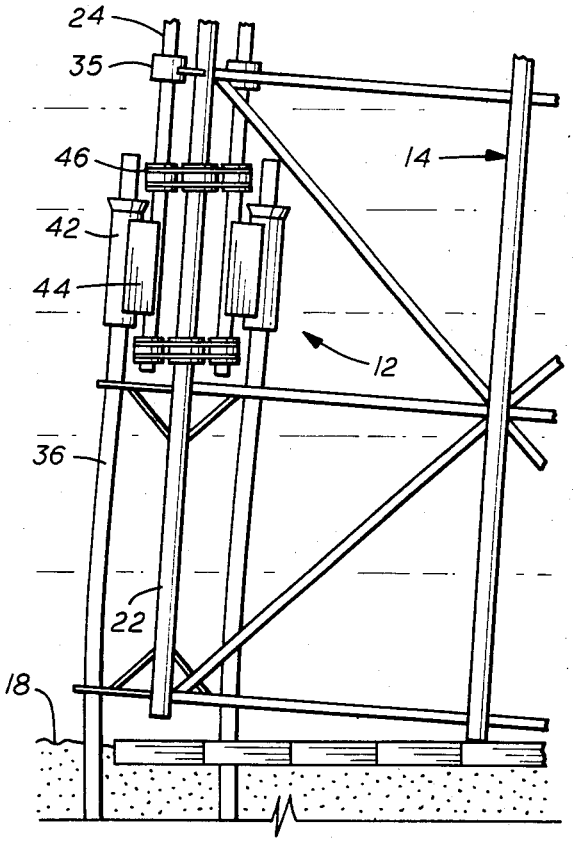

FIG. 1 shows an elevational view of a compliant piled tower 10 ("CPT") adapted for use as an oil and gas drilling and production structure. The CPT 10 is provided with a number of pile assemblies 12, each incorporating a preferred embodiment of the present invention. A description of this preferred embodiment is set forth below. Though the preferred embodiment of the pile assembly 12 is adapted for use in providing vertical support and lateral stability to compliant offshore structures, with appropriate modifications the pile assembly is broadly useful for any application in which it is desirable to have a marine pile extend a significant distance above the ocean floor. To the extent that the following description details a specific embodiment of the pile assembly and the CPT with which it may be used, this is by way of illustration rather than limitation.

The CPT 10 includes a substantially stiff tower 14 extending from a tower base portion 16 on the ocean floor 18 to position above the ocean surface. In the preferred embodiment the tower 14 is a tubular steel space frame structure having a plurality of substantially vertical primary legs 22. A deck 20 provided with hydrocarbon drilling and production equipment is supported atop the tower 14. Associated with each of the primary legs 22 is a pile assembly 12 driven into the ocean floor 18 and extending upward to an attachment location 25 a spaced distance above the ocean floor 18. The pile assemblies 12 serve to support the majority of the submerged weight of the CPT 10 and to provide the stabilization necessary to counteract tower sway resulting from the action of waves, wind and ocean currents.

Figure 3:
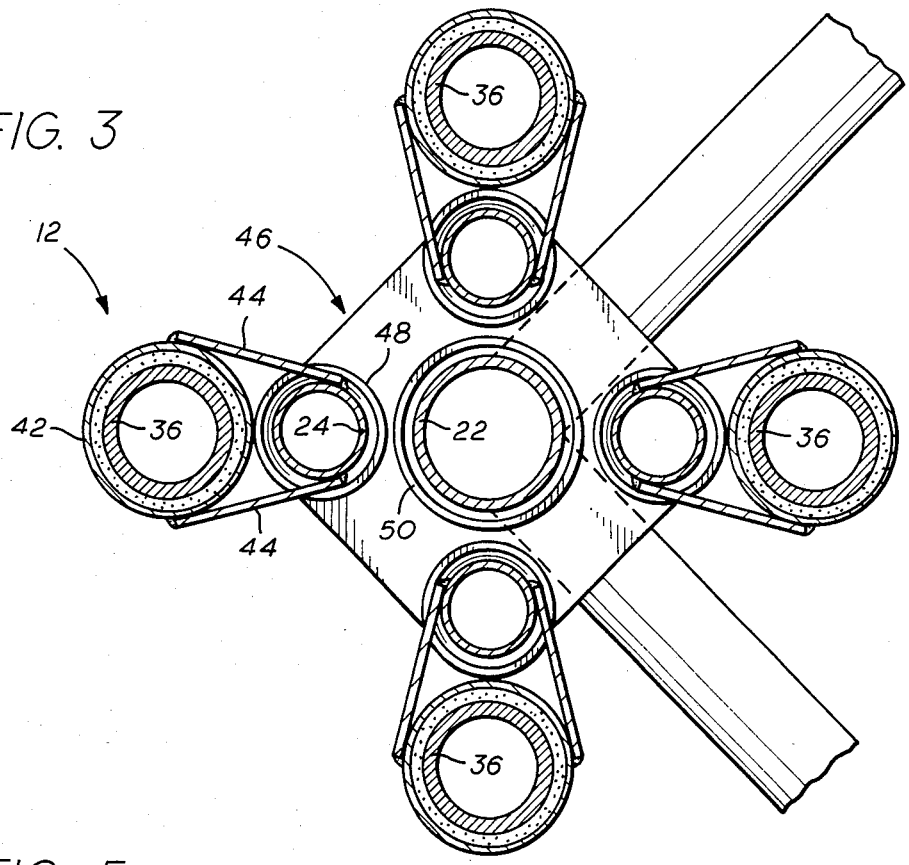
FIG. 3 is a cross-sectional view taken along line 3—3 of FIG. 2.

Each of the pile assemblies 12 includes a plurality of tubular steel flex piles 24 having opposed upper and lower ends 26, 28. The flex piles 24 extend substantially parallel to the corresponding one of said tower legs 22 from a position proximate the ocean floor 18 upward to the flex pile attachment location 25, where the flex piles 24 of each pile assembly 12 are rigidly secured to the corresponding platform leg 22. In many applications, it is desirable to have the pile attachment location 25 at about one-half the total tower height. As best shown in FIG. 3, the flex piles 24 are symmetrically arranged around the tower leg 22. Flex pile guides 35 are provided along the length of the primary legs 22 to support the flex piles 24 against buckling under compressive loading.

Figure 2:
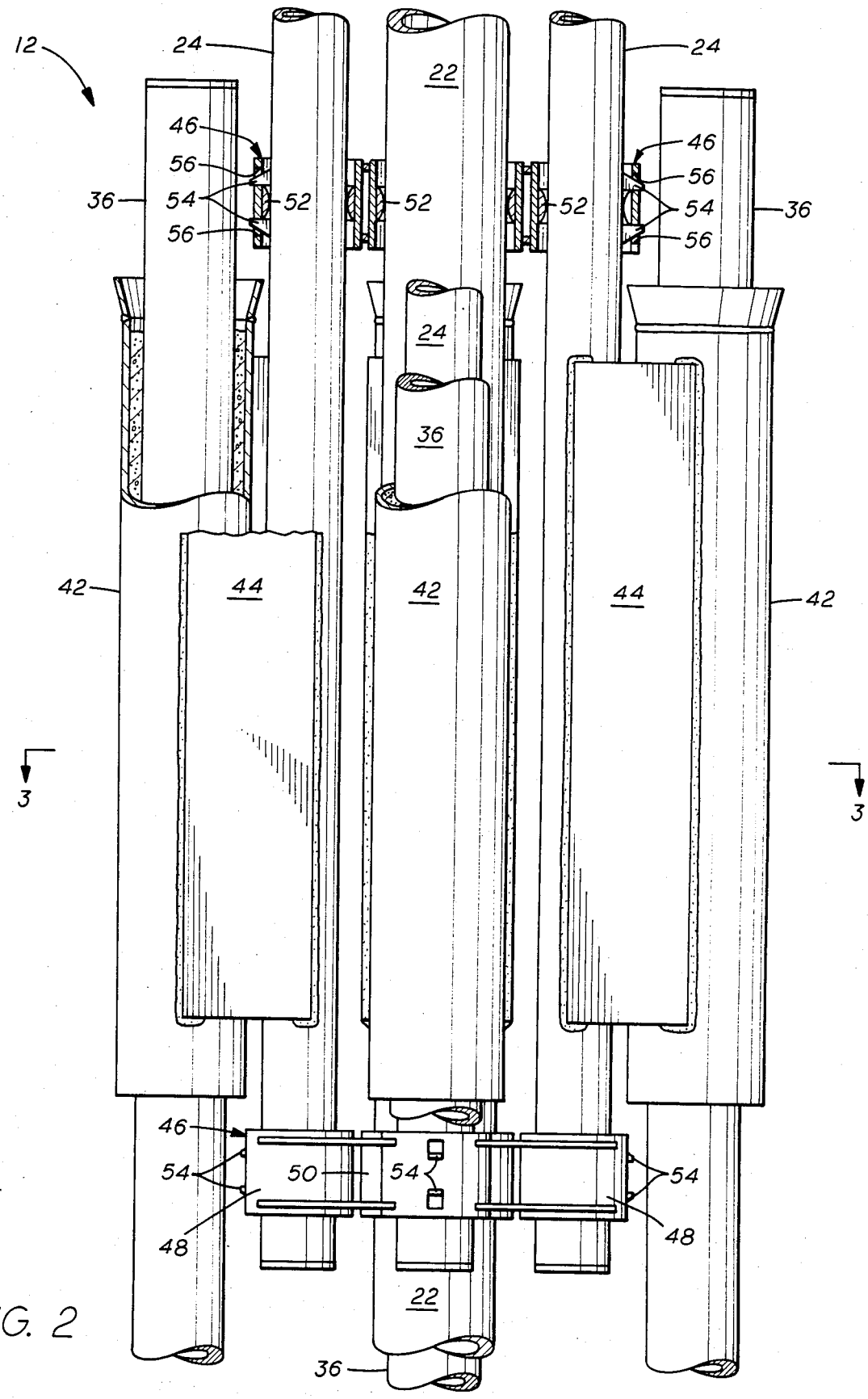
FIG. 2 shows a detailed view of the lower portion of one of the pile assemblies of FIG. 1.

Each pile assembly 12 also includes a plurality of tubular steel drive piles 36 extending downward into the ocean floor 18 a distance sufficient to support the loads borne by the pile assembly 12. To satisfy driving considerations, the drive piles 36 will typically have a greater diameter and wall thickness than the flex piles 24. The upper end 38 of each drive pile 36 projects above the ocean floor 18 to an elevation somewhat above the lowermost portion of the flex piles 24. In the preferred embodiment, there are equal numbers of flex piles 24 and drive piles 36, with the upper end 38 of each of the drive piles 36 being laterally adjacent to the lower end 28 of the corresponding one of the flex piles 24 as best shown in FIG. 2. By positioning each drive pile 36 so that its longitudinal axis is eccentric to its corresponding flex pile 24, vertical access to each drive pile 36 is unobstructed, simplifying installation of the CPT 10, as detailed below. As used in this specification and the appended claims, the term "laterally adjacent" as used in describing the position of each flex pile 24 relative to the corresponding drive pile 36 shall mean that the lower end of the flex pile 24 does not pass through the region directly above the upper end of the flex pile 36. For tubular piles this requires that the spacing between the central axes of each corresponding flex pile and drive pile be equal to or greater than one-half the sum of the diameters of the flex pile and drive pile. With the minimum practical spacing this would cause the flex pile and drive pile to abut one another at their outer surfaces. More typically, as shown in the illustrations, there would be a small lateral gap between the flex pile and drive pile. It is not necessary to the present invention that the lowest end of the flex pile extend below the upper end of the drive pile.

It is desirable to cluster the flex piles 24 nearest the tower leg 22 and to position each drive pile 36 radially outward, relative to the platform leg 22, from the corresponding flex pile 24. This arrangement, best illustrated in FIG. 3, minimizes the moment imposed at the flex pile attachment location 25, optimizes hydrodynamic shielding of the flex piles 24, and minimizes group effects among the drive piles 36. In the preferred embodiment, the longitudinal axis of each drive pile 36 will be substantially parallel to that of the flex piles 24 and the lower leg 22. However, in some embodiments it may be desirable to incline the upper end 38 of each drive pile 36 slightly toward the corresponding tower leg 22. This causes each of the drive piles 36 to extend downward in a direction slightly outward from the longitudinal axis of the lower leg 22, thereby avoiding or minimizing pile group effects. The term "drive pile" as used in the present specification and the appended claims includes not only piles which are driven into the ocean floor in the conventional manner, but also piles which are set into the ocean floor by other means, as for example by jetting.

As best shown in FIGS. 2 and 3, each of the drive piles 36 is rigidly secured to the corresponding flex pile 24 in laterally adjacent relationship. A sleeve 42 is secured to the lower end 28 of each flex pile 24 by shear plates 44. The drive pile 36 is grouted within the sleeve 42. This arrangement greatly facilitates the critical step of platform installation. The tower 10 is fabricated with the flex piles 24 and their corresponding drive pile sleeves 42 in place. Upon completion of fabrication, the tower 14 is transported to the installation site by launch barge. The tower legs 22 are sealed so that upon being launched, the platform floats horizontally on the ocean surface. The legs 22 are then controllably ballasted with seawater to upend the tower 14 and cause it to come to rest at the desired location on the ocean bottom 18. The drive piles 36 are then driven in a conventional manner through the sleeves 42. Once the driving of each drive pile 36 is complete, it is grouted within the sleeve 42. After all the drive piles 42 of each pile assembly 12 have been driven and grouted, the deck 20 is mounted atop the tower 14. The legs 22 are partially deballasted to offset a portion of the weight increase resulting from the addition of the deck 20. The remainder of the increased submerged weight is supported primarily by the pile assemblies 12.

In shallow water applications and in relatively severe environments, such as the North Sea, establishing adequate axial flexibility of the flex piles 24 may require the use of a flex pile having an effective length as great or greater than the water depth at the installation site. For such applications a telescoping pile, as taught in U.S. Pat. No. 4,378,179, issued Mar. 29, 1983 may be used as the flex pile 24. The eccentric alignment established between each flex pile and its corresponding drive pile in the present invention greatly simplifies the use of a telescoping flex pile. A concentric telescoping flex pile, drive pile assembly would pose considerable installation problems.

The eccentric drive pile, flex pile arrangement incorporated in the present invention results in the establishment of a moment when the pile assembly 12 is placed under load. Were this moment not corrected, it would cause a significant horizontal reaction load at the flex pile guides 35. Coupled with the relative motion between the guides and flex pile occuring during tower sway, this reaction load would result in wear at each interface between the guides 35 and flex pile 24. To accommodate the lateral reaction established by pile eccentricity, the pile assemblies 12 of the present invention are placed in symmetric clusters and laterally joined together by tie members 46 positioned above and below the point of attachment between the drive pile 36 and flex pile 24. The tie members 46 serve as means for maintaining the lower ends 28 of the flex piles 24 at a fixed distance from one another. The tie members 46 permit the flex pile lower ends 28 to move only as a unit in the lateral direction. The tie members 46 preferably permit the flex piles 24 to move independently of one another in the vertical direction. In the preferred embodiment, the tie members 46 are ring beams. The tie members 46 cause the lateral reactions existing for each of the flex piles 24 to be transmitted through the tie member 46 and balanced by the lateral reactions existing for the other flex piles 24 of the pile assembly 12. This largely eliminates any lateral reaction between the tower legs 22 and flex piles 24, minimizing wear at the guides 35 in the course of tower sway.

The tie members 46 preferably include a pile sleeve 48 surrounding each of the flex piles 24 and a central sleeve 50 surrounding the platform leg 22. Thus, the flex piles 24 are maintained not only in fixed lateral relationship to one another, but each is also maintained in fixed lateral relationship to the platform leg 22. As shown in FIG. 2, a guide surface 52 is mounted within each of the sleeves 48,50. To avoid binding between the guide surface 52 and flex piles 24 or leg 22 in the course of sway, the guide surface 52 is toroidal and has a minimum inside diameter which exceeds the outside diameter of the corresponding flex pile 24 or leg 22 by an amount equal to g where:

$$g=\tfrac{1}{2}(R_G+R_L)\,[(\cos\Theta)^{-1}-1]$$

where $R_G$=minimum inside radius of the guide surface;

$R_L$=outside radius of flex pile or leg; and $\Theta$=maximum tower sway

In most applications it will be necessary for the guide surface 52 to have a somewhat larger inside diameter to account for member out-of-roundness. Stops 54 are secured to the flex piles 24 and extend through slots 56 in the tie members 46 to prevent the tie members from moving downward on the pile assembly 12. The tie members 46 are designed to avoid imposing any vertical restraint on the flex piles 24 or the tower leg 22 in the course of tower sway. Were the tie members 46 to impose vertical restraint (as, for example, by using plates welded between the flex piles 24 as tie members), tower sway would impose potentially damaging bending stresses on the flex piles 24.

Figure 5:
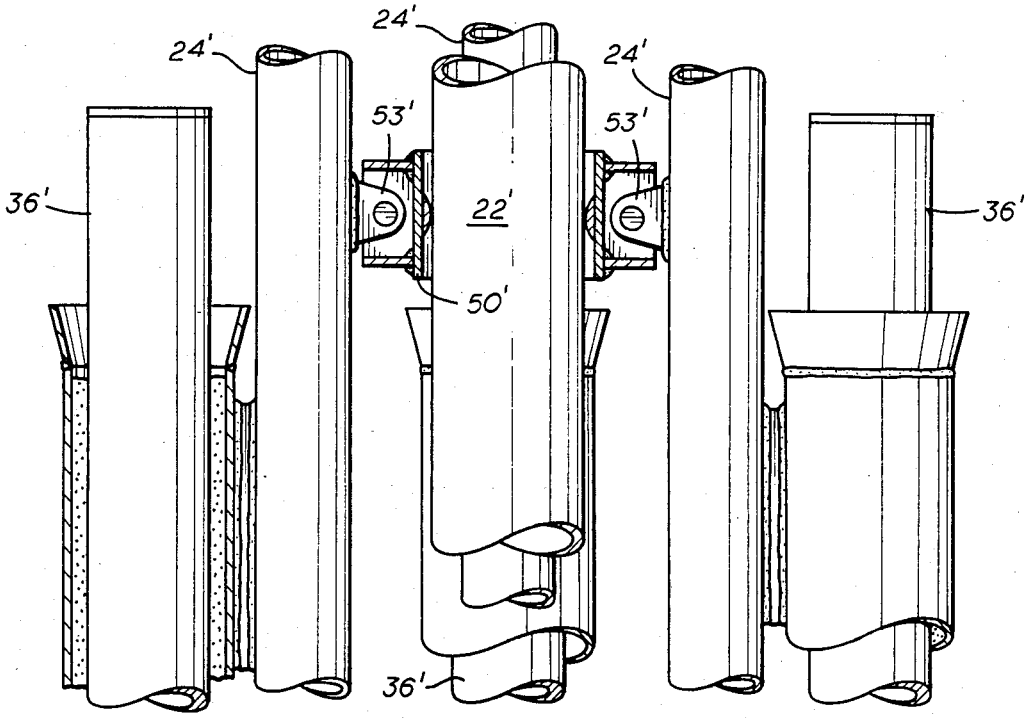
FIG. 5 is an elevational view of a second embodiment of the present invention.

FIG. 5 illustrates an alternative to the use of a ring beam as the tie member 46. In this embodiment, the tie member 46′ includes a platform leg sleeve 50′ secured to the corresponding flex piles 24′ by pinned connections 53′. As in the previous embodiment, the tie member 46′ serves solely to maintain the flex piles 24′ and the corresponding platform leg 22′ in fixed lateral relationship while freely permitting vertical motion of the platform leg 22′ and tilting of the flex piles 24′ occurring in the course of platform sway.

The present invention, exemplified by the two embodiments detailed above, provides several advantages over alternate CPT pile assembly designs. The primary advantage is achieved through separation of the driven portion of the pile from the exposed flex piles. The diameter and thickness of the drive pile can be based wholly on foundation capacity and driving considerations without being constrained by geometric considerations of the flex piles. Similarly, there is increased latitude in the design of the flex piles, permitting the use of high strength steels or alternate materials having a lower modulus of elasticity, such as aluminum. Further, if a reduction in the cross-sectional area of the flex piles can be achieved, then a proportional reduction in the flex pile length can be made while retaining the same axial flexibility. This decreases the weight and cost of the pile assembly. Additionally, the diameter to thickness ratio of the flex piles can be reduced to the point where the preinstalled flex piles can be capped and buoyant during platform towing and installation without danger of differential pressure collapse of the lower portion of the flex piles.

The use of the present invention also allows the center to center spacing of the flex piles to be greatly reduced without compromising the spacing of the drive piles. This enhances the hydrodynamic shielding of the piles, reducing the drag load imposed on the CPT 10 by ocean currents. Further, the reduced distance between the tower legs 22 and the flex piles 24 results in a reduction of the eccentricity of the pile reaction which must be transmitted between the flex pile 24 and the tower leg 22. Additionally, the eccentric alignment of the flex piles 24 relative to the drive piles 36 permits unobstructed vertical access to the drive piles, greatly facilitating driving the drive piles 36.

The preferred embodiment of the present invention and the preferred methods of using it have been detailed above. It should be understood that the foregoing description is illustrative, and that other embodiments of the invention can be employed without departing from the full scope of the invention as set forth in the appended claims.

We claim:

1. A pile assembly adapted for use in supporting a compliant offshore structure having a plurality of vertical support legs extending from the ocean floor to a work deck proximate the ocean surface, said pile assembly comprising:

a plurality of elongate, substantially vertical lower piles set into the ocean floor;

a plurality of elongate, substantially vertical upper piles having opposed upper and lower end portions, the lower end portion of each of said upper piles being laterally adjacent and fixedly secured to the upper end of at least one of said lower piles;

means for securing the upper end portion of each of said upper piles to a corresponding one of said vertical support legs; and means for maintaining a fixed spacing between the lower ends of said upper piles.

2. The pile assembly as set forth in claim 1 wherein said upper and lower piles are arranged in a substantially symmetric array about a substantially vertical pile assembly central axis.

3. The pile assembly as set forth in claim 2 wherein there are equal numbers of upper and lower piles, with each upper pile being rigidly secured to a single corresponding lower pile.

4. The pile assembly as set forth in claim 3 wherein each lower pile is positioned in the plane defined by the axis of the corresponding upper pile and the pile assembly central axis.

5. The pile assembly as set forth in claim 1 wherein said means for maintaining a fixed spacing is a ring beam having a plurality of apertures, each upper pile passing through a corresponding one of said apertures.

6. The pile assembly as set forth in claim 1 wherein said lower piles are drive piles and said upper piles are telescoping flex piles.

7. The pile assembly as set forth in claim 1 wherein said means for maintaining fixed spacing is adapted to permit limited vertical motion of at least one of the upper piles relative to the other upper piles.

8. A pile assembly adapted to provide support for an offshore structure, said offshore structure having a base resting upon the ocean floor and a plurality of substantially vertical primary support legs extending upward from said base to a work deck situated above the ocean surface, said pile assembly comprising:

a drive pile extending into the ocean floor, said drive pile having an upper end situated proximate said offshore structure base;

an elongate flex pile having opposed upper and lower ends, said flex pile lower end being laterally adjacent to said drive pile upper end, whereby vertical access to said drive pile upper end is free from being obstructed by said flex pile lower end, said flex pile extending upward along a corresponding one of said primary support legs from said drive pile to a preselected elevation on said corresponding primary support leg;

a connector at the upper end of said flex pile for securing said flex pile to said corresponding primary support leg whereby loads are transferred from said offshore structure into said pile assembly through said connector; and means for securing said flex pile lower end to said drive pile upper end whereby axial loadings imposed on said flex pile are transferred to said drive pile.

9. The pile assembly as set forth in claim 8, wherein said pile assembly includes at least two flex piles, each of said flex piles having a lower end laterally adjacent to said drive pile upper end, each of said flex piles extending generally upward from said drive pile.

10. The pile assembly as set forth in claim 8, wherein said pile assembly includes a plurality of drive piles and a plurality of flex piles, and wherein said pile assembly further includes means for retaining the lower ends of said flex piles in fixed lateral relationship to one another.

11. A pile assembly adapted for use in stabilizing a compliant offshore structure, comprising:

a plurality of drive piles extending downward into the ocean floor, each of said drive piles having an upper end proximate said ocean floor, said drive piles being substantially symmetrically arranged about a central axis of symmetry;

a plurality of flex piles each having an upper and a lower end, said flex piles being generally parallel to one another, the lower end of each flex pile being positioned proximate said drive pile upper ends, said flex pile upper ends being secured to said structure a spaced distance above the ocean floor, said flex piles being symmetrically arranged about said central axis of symmetry;

means for maintaining said flex pile lower ends in fixed lateral spacing relative to one another; and means for rigidly securing the upper end of each of said drive piles in fixed lateral relationship to the lower end of a corresponding one of said flex piles, whereby axial loadings imposed on said flex piles by said compliant offshore structure are transferred to the ocean floor through said drive piles and whereby vertical access to the upper end of each of said drive piles is unobstructed by said flex piles.

12. The pile assembly as set forth in claim 11, wherein said securing means includes a ring beam through which the lower end of each flex pile passes.

13. The pile assembly as set forth in claim 11, wherein each pile assembly includes an equal number of drive piles and flex piles, said pile assembly being adapted to extend along a leg of said structure with said central axis of symmetry being substantially collinear with the longitudinal axis of said leg, said flex piles being arranged symmetrically around said leg and each drive pile being radially outward from a corresponding one of said flex piles and rigidly secured to said corresponding flex pile.

14. The pile assembly as set forth in claim 13 wherein said flex piles are telescoping piles.

15. The pile assembly as set forth in claim 11 wherein said securing means is adapted to permit limited vertical motion of at least some of said flex piles relative to the others of said flex piles.

16. A pile assembly adapted for use in stabilizing a compliant offshore platform, said pile assembly comprising:

a plurality of drive piles driven into the ocean floor, said drive piles each having an upper end proximate said ocean floor, said drive piles being substantially symmetrically arranged about a central vertical axis of symmetry;

a plurality of elongate flex piles each having an upper and a lower end, said flex piles extending upward in symmetric array about said central axis of symmetry, said upper end of each flex pile being secured to said platform;

means for maintaining the lower ends of said flex piles in fixed lateral relationship to one another; and means for securing each flex pile to at least one of said drive piles with said flex piles being eccentrically oriented relative to each of said drive piles.

17. The pile assembly as set forth in claim 16 wherein said securing means includes a rigid joint between each flex pile and the corresponding one of said drive piles.

18. The pile assembly as set forth in claim 16 wherein said drive piles and said flex piles are substantially cylindrical members with the spacing between the longitudinal axes of each flex pile and the drive pile to which it is secured being at least equal to one-half the sum of the diameters of said flex pile and drive pile.

19. The pile assembly as set forth in claim 17 wherein said rigid joint includes a sleeve secured to said flex pile, said drive pile being driven through and rigidly secured within said sleeve.

20. A compliant offshore platform, comprising:

a plurality of primary support legs extending from the ocean bottom to a position proximate the ocean surface;

a plurality of elongate drive piles set into the ocean floor in a symmetric array about each of said primary support legs, said drive piles having upper ends proximate said ocean floor; and a plurality of flex piles extending upward in a symmetric array about each of said primary support legs, said flex piles having an upper end secured to said primary support leg a spaced distance above the ocean floor and a lower end rigidly connected to the upper end of at least one of said drive piles, the lower end of each of said flex piles being laterally offset from the upper end of each of said drive piles, whereby vertical access to the upper end of each of said drive piles is unobstructed by said flex piles.

21. The compliant offshore platform as set forth in claim 20 further comprising means for maintaining the lower ends of said flex piles in fixed lateral relationship to one another.

22. The compliant offshore platform as set forth in claim 21 wherein said means for maintaining is adapted to permit the lower end of each of said flex piles to freely move in the vertical direction relative to the other flex piles.

* * * * *